US006364134B1

(12) United States Patent
Christy

(10) Patent No.: US 6,364,134 B1
(45) Date of Patent: Apr. 2, 2002

(54) PRODUCT STOCKING METHOD AND DEVICE

(75) Inventor: Michael W. Christy, Columbus, GA (US)

(73) Assignee: Goody Products, Inc., Manchester, GA (US)

( * ) Notice: Subject to any disclaimer, the term of this patent is extended or adjusted under 35 U.S.C. 154(b) by 0 days.

(21) Appl. No.: 09/575,049

(22) Filed: May 19, 2000

(51) Int. Cl.[7] ..... B42F 17/00
(52) U.S. Cl. ..... 211/59.1
(58) Field of Search ..... 211/59.1, 54.1, 211/57.1; 248/220.4

(56) References Cited

U.S. PATENT DOCUMENTS

| | | | | | |
|---|---|---|---|---|---|
| 1,900,574 | A | | 3/1933 | Meader | |
| 2,078,018 | A | | 4/1937 | Powell | 206/44 |
| 2,967,611 | A | | 1/1961 | Bolinger | 206/57 |
| 3,029,486 | A | | 4/1962 | Raymond | 24/73 |
| 3,148,770 | A | | 9/1964 | Cosman | 206/57 |
| 3,211,293 | A | | 10/1965 | Tarnoff | 211/59 |
| 3,313,407 | A | | 4/1967 | Palm, Jr. | 206/65 |
| 3,314,530 | A | | 4/1967 | Michalka | 206/44 |
| 3,721,339 | A | | 3/1973 | Seyer | 206/65 |
| 3,856,137 | A | | 12/1974 | Brindley | 206/73 |
| 3,927,761 | A | | 12/1975 | Boyle | 206/45.14 |
| 3,952,782 | A | | 4/1976 | Consiglio, Jr. | 206/526 |
| 4,018,341 | A | * | 4/1977 | Jarecki | 211/59.1 |
| 4,026,508 | A | * | 5/1977 | Ziegler | 211/59.1 |
| 4,072,232 | A | | 2/1978 | Marsman | 206/602 |
| 4,362,249 | A | * | 12/1982 | Thalenfeld | 211/59.1 |
| 4,394,909 | A | * | 7/1983 | Valiulis et al. | 211/59.1 |
| 4,427,114 | A | | 1/1984 | Howell et al. | 206/328 |
| 4,582,194 | A | | 4/1986 | Karpiloff et al. | 206/44 R |
| 4,694,595 | A | * | 9/1987 | Fast | 211/59.1 |
| 4,726,554 | A | * | 2/1988 | Sorrell | 211/59.1 |
| 4,783,033 | A | * | 11/1988 | Valiulis | 211/59.1 |
| 4,796,759 | A | | 1/1989 | Schisler | 206/554 |
| 4,895,255 | A | | 1/1990 | Fisher | 206/497 |
| 4,973,212 | A | | 11/1990 | Jacobs | 411/508 |
| 5,054,727 | A | | 10/1991 | Campbell | 248/220.3 |
| 5,080,238 | A | * | 1/1992 | Hochman | 211/59.1 |
| 5,363,964 | A | | 11/1994 | Hexter, Jr. | 206/449 |
| 5,573,117 | A | | 11/1996 | Adams | 206/449 |
| 5,632,387 | A | | 5/1997 | Johnson | 211/59.1 |
| 5,730,296 | A | | 3/1998 | Limmer | 206/738 |
| 5,855,347 | A | * | 1/1999 | Hollingsworth et al. | 211/59.1 |
| 5,901,860 | A | | 5/1999 | Nowicki | 211/59.1 |
| D412,631 | S | | 8/1999 | Green | D6/467 |
| 5,957,285 | A | | 9/1999 | Lai | 206/372 |
| 6,050,420 | A | | 4/2000 | Green | 206/764 |
| 6,186,455 | B1 | * | 2/2001 | Hollingsworth et al. | 211/59.1 |

* cited by examiner

*Primary Examiner*—Alvin Chin-Shue
*Assistant Examiner*—Sarah Purol
(74) *Attorney, Agent, or Firm*—Foley & Lardner

(57) ABSTRACT

A stocking device is disclosed. The stocking device retains a plurality of display packages so that the plurality of packages are readily aligned for simplified mounting onto a display hanger. The stocking device has a base and a shaft, the shaft is inserted into apertures in the plurality of display packages, which are held in place by a portion of the shaft having a diameter greater than the diameter of the aperture.

28 Claims, 6 Drawing Sheets

PRODUCT STOCKING METHOD AND DEVICE

FIELD OF THE INVENTION

The invention relates to a product stocking device for placing a plurality of packaged products on a display hanger in a substantially single motion.

BACKGROUND OF THE INVENTION

It is well known to display products using a variety of packages, including bags, blister packs, cards, display containers, or the like. Such packages typically have an aperture adjacent the top of each package such that the packages may hang from hangers or hooks that extend from a display wall.

Conventionally, to display the packages, a stocker picks up single packages from a box (or other container holding a multiplicity of packages) and mounts each package individually onto the hanger or hook. Alternatively, a stocker takes a plurality of packages and aligns the mounting apertures by hand and in turn mounts the plurality of packages onto a hanger. The conventional process of mounting the packages onto the hangers or hooks is a tedious and time consuming task that involves exceedingly repetitive work for the stocker. Such tedious repetitive work increases costs for the store and also increases the chances of damage to the product or the product packaging if the package is dropped or otherwise mishandled while being placed onto the hangers or hooks.

It is known in the art to insert a common twist tie or plastic loop through the apertures of a plurality of packages. The twist tie causes general coaxial alignment of the bag apertures. A twist tie, however, has the disadvantage of being difficult to manually disengage from the plurality of bags without the use of a suitable tool, such as a pair of scissors. Also, a twist tie requires substantial time to insert through a plurality of bags. Further, a twist tie does not have an area providing for easy grasping by a stocker. It is also known that a rubber band can be placed around the plurality of packages held together by a twist tie to assist in product alignment.

Thus, there is a need and desire for a device that improves the efficiency of handling a multiplicity of packages to be mounted onto hangers or hooks. There is also a need and desire for an efficient method of organizing a plurality of packages for storage, shipment, or sales display. Further, there is a need and desire for a device which keeps a plurality of packages together so that the plurality of packages can be easily mounted onto hangers or hooks in a substantially single motion. Further still, there is a need and desire for a device that holds together a plurality of packages that can be easily manufactured, with little expense, and that can be easily packaged along with the plurality of packages in a case or box.

SUMMARY OF THE INVENTION

The present invention relates to a stocking device for holding a plurality of packages, each package having an aperture. The stocking device includes a base and a shaft extending from the base and including a bump intermediate the ends of the shaft.

The present invention also relates to a method of organizing a plurality of packages, each package having an aperture. The method includes providing a stocking device including a base, a shaft extending from the base, and a bump intermediate the ends of the shaft, positioning the aperture of one or more packages near the end of the shaft remote from the base, and sliding the packages over the bump toward the base.

The present invention further relates to a method of stocking a plurality of packages, each package having an aperture. The method includes coupling a stocking device to a hanger or hook, the stocking device including a base, a shaft extending from the base and having a bump intermediate the ends of the shaft, and a plurality of packages being slidably disposed on the shaft between the base and the bump, and sliding packages onto the hanger or hook.

Figure 1:
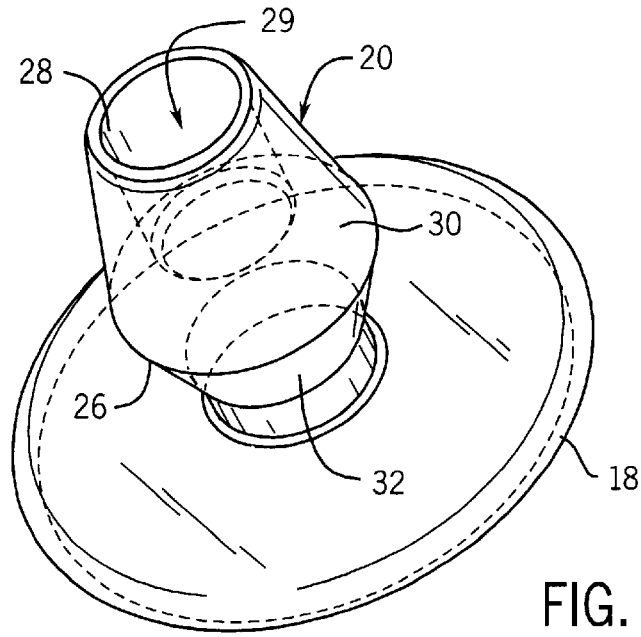
FIG. 1 is a perspective view of a stocking device according to a preferred embodiment.
Figure 2:
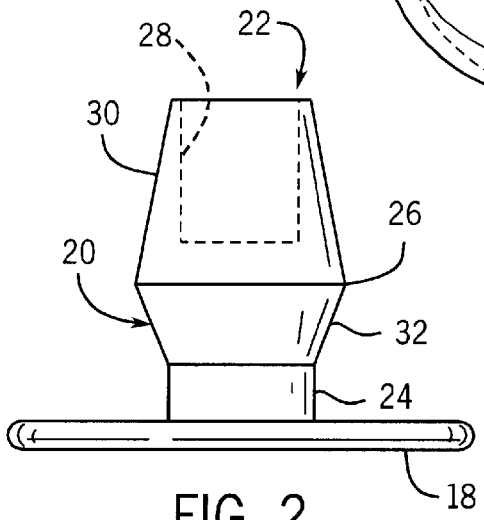
FIG. 2 is a side elevation view of the stocking device.
Figure 3:
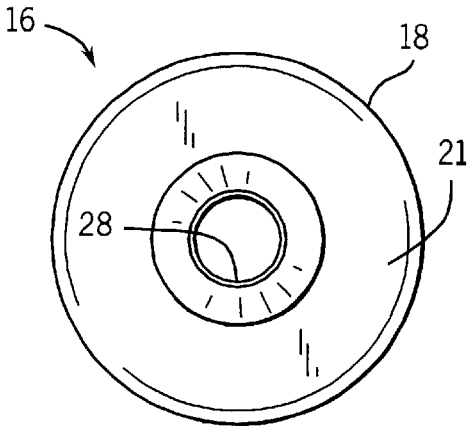
FIG. 3 is a top elevation view of the stocking device.
Figure 4:
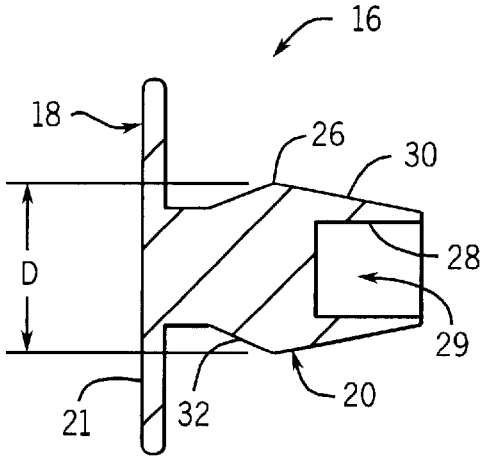
FIG. 4 is a sectional elevation view of the stocking device of FIG. 2 taken along the line 4—4.
Figure 5:
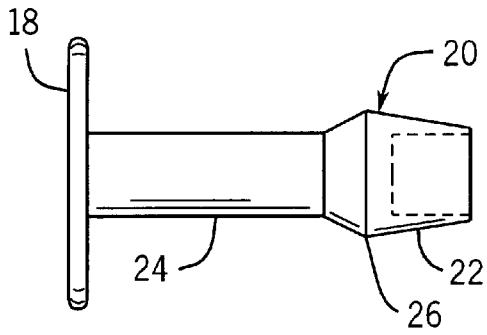
FIG. 5 is a side elevation view of the stocking device according to an alternate embodiment.

DETAILED DESCRIPTION OF PREFERRED, PARTICULARLY PREFERRED, AND ALTERNATE EMBODIMENTS

A product stocking device is configured to provide an inexpensive and efficient device for handling (e.g., packaging, organizing, storing, shipping, and stocking) a plurality of packages.

A particularly preferred application of the stocking device and method is in packaging, organizing, storing, shipping, and stocking items onto a variety of display devices in a substantially single step or motion. Such items may include, for example, the products themselves or products contained in any of a variety of packaging (including display bags, blister packs, display cards, display containers, etc.). The display devices may include, for example, display hangers or hooks or other elongated rods, hooks, or elements that extend from a vertical surface of a display (hereinafter referred to as a "hanger"). The stocking device and method is intended to decrease the labor used to organize or "bundle" a plurality of packages in an organized fashion without employing other packaging elements (e.g., twist ties, elastic bands, etc.), and to stock the packages on hangers.

Referring to the FIGURES, each display package (shown as a bag 10) contains a product, such as, but not limited to, elastic hair bands, hardware items, school or office supplies, etc. Each bag 10 includes an aperture 12 adjacent its top for mounting onto a display device (shown as a hanger 14, which extends from an upright display, wall, display case, or the like). Bags 10 shown in the FIGURES are exemplary of the type of display packages that can be utilized with the stocking device; however, any of a variety of display packages having at least one aperture for hanging on a hanger, peg, or hook, may be used. According to an alternate embodiment wherein the products are sold without separate packaging, the products themselves may include an aperture for mounting on display devices. As such, stocking device 16 would be configured to engage the aperture, or comparable feature, on the products themselves.

Referring to FIGS. 1–4, stocking device 16 is shown according to an exemplary embodiment. Stocking device 16 includes a base 18 and a shaft 20 extending from base 18. According to a particularly preferred embodiment, the stocking device is made of a plastic material.

Base 18 is shown as a circular member configured to provide a stocker with a member to handle or manipulate stocking device 16, or to provide a coupling member for a packaging machine or fixture. According to a preferred embodiment, base 18 includes an area 21 for labeling or other indicia (e.g., product identification, shipping origin, shipping destination, seller information, UPC code data, buyer/customer information, etc.).

Shaft 20 includes a loading section 22 and a storage section 24 that are configured to engage and retain one or more bags 10. A portion of shaft 20 is shaped and sized with an expanded dimension relative to shaft 20 (the expanded portion is hereinafter referred to as a bump 26), which is configured to gradually expand (e.g., stretch flex, etc.) apertures 12 as bags 10 are slid along shaft 20 (i.e., loaded or unloaded).

According to a preferred embodiment, bump 26 includes a dimension (e.g., diameter D) that is greater than a corresponding dimension on aperture 12. As shown in the FIGURES, bump 26 includes an expanded diameter when compared to sections 22 and 24, and is disposed between loading section 22 and storage section 24. According to a particularly preferred embodiment, shaft 20 is cylindrical in shape and bump 26 includes a first ramped surface (shown as a conically-shaped first portion 30) having its smaller diameter nearest base 18, a second ramp surface (shown as a conically-shaped second portion 32 extending toward the outer end of the stocking device 16).

Bump 26 is configured to resistively prevent bags 10 from being pulled off of shaft 20 by dimensional interference with aperture 12 (e.g., the diameter of aperture 12 is less than the largest diameter of bump 26). For example, the bump may have any of a variety of shapes and sizes which generally correspond with the shape and size of the aperture (e.g., triangular, rectangular, circular, ovular, clover-leaf, etc.) or could be slotted to allow deflection or distortion of the packaging having apertures not designed to expand. According to an alternate embodiment, other geometric configurations for shaft 20 and bump 26 could be used to prevent the apertures 12 from being inadvertently pushed over bump 26.

Figure 8:
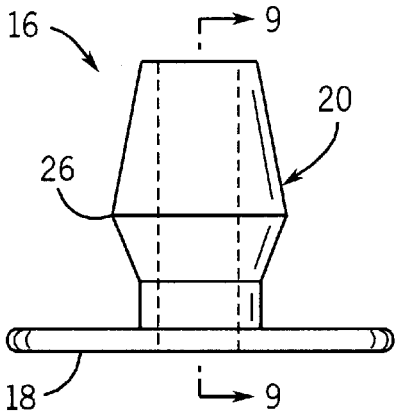
FIG. 8 is a side elevation view of the stocking device according to an alternate embodiment.
Figure 9:
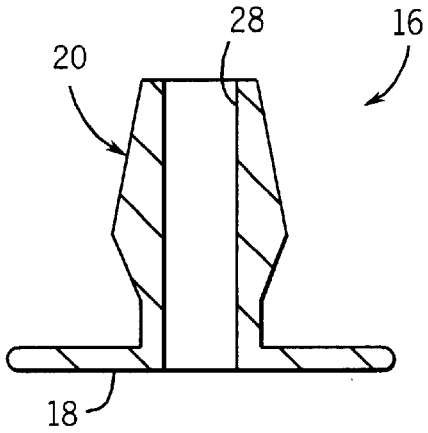
FIG. 9 is a sectional elevation view of the stocking device of FIG. 8 taken along the line 9—9.

Shaft 20 further includes a bore 28 defining a coupling receptacle 29 configured to receive hanger 14. According to a preferred embodiment, bore 28 is disposed partially along the outer end of shaft 20 of stocking device 16. According to an alternate embodiment (shown in FIGS. 8 and 9), bore 28 extends along the entire length of the stocking device 16 (e.g., for use with automatic loading machines, fixtures, etc.). According to a further embodiment, bore 28 may have a variety of shapes and sizes, which are configured to receive hanger 14.

According to still further embodiments, stocking device 16 may be configured in a variety of other arrangements and manufactured from a variety of materials having portions that extend through the packages. For example, the stocking device may be a button having a single shaft extending therefrom, or it may have a plurality of shafts that are configured to align and engage a plurality of hangers.

Figure 10:
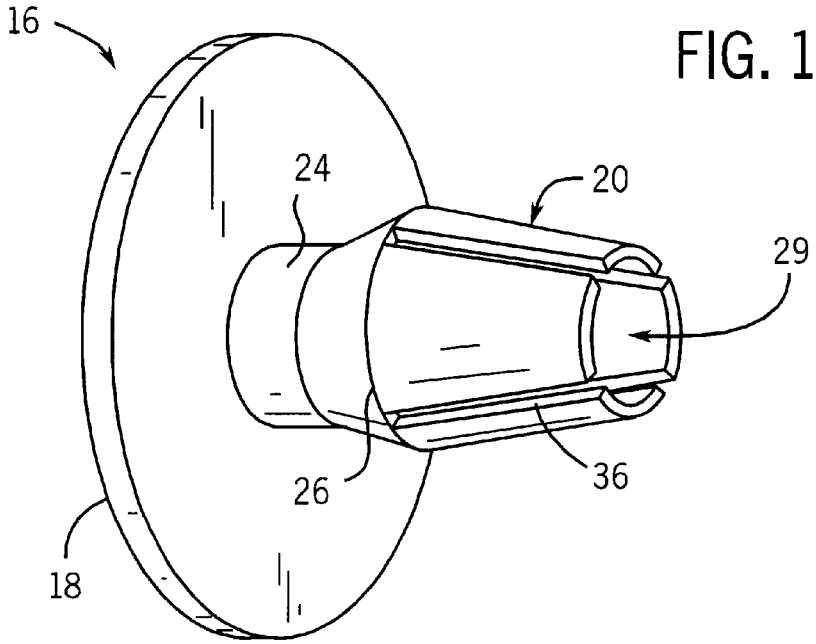
FIG. 10 is a perspective view of a stocking device according to an alternate embodiment.
Figure 11:
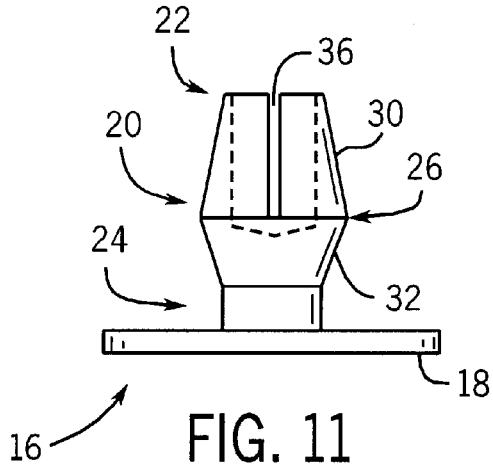
FIG. 11 is a side elevation view of the stocking device of FIG. 10.
Figure 12:
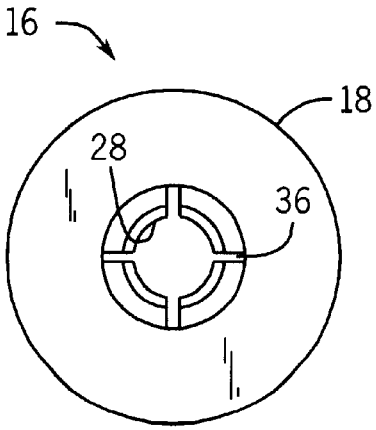
FIG. 12 is a top elevation view of the stocking device of FIG. 10.

In operation, stocking device 16 is used to hold one or more bags 10 so that bags 10 are organized for storage, shipment, stocking, etc. At a packaging facility, products are bagged and sealed in bags 10. Bags 10 are then loaded onto stocking device 16 by inserting shaft 20 of stocking device 16 through aperture 12 of one or more bags 10 (such as four bags 10, in the exemplary embodiment, depicted in FIG. 10) with sufficient force to slightly deform bag 10 about aperture 12 so that bags 10 pass over bump 26. According to alternate embodiments, the stocking device can be sized to accommodate any number of packages. According to the alternate embodiment shown in FIGS. 6 and 7, shaft 20 of stocking device 16 may have a greater length to accommodate the desired product capacity. For example, carded blister packs may require a longer shaft than thin plastic film bags. A longer shaft could also be used if a larger number of products are intended to be loaded and unloaded (i.e., organized, stored, shipped, stocked, etc.). According to a further alternate embodiment (as shown in FIGS. 10–12), bump 26 includes slots 36 configured to allow compression of the bump when loading and unloading product packages with apertures that are not intended to expand (e.g., cards). Slots 36 may be disposed along a portion of shaft 20 or along substantially the entire length.

According to a preferred embodiment, stocking device 16 is mounted on a packaging machine or fixture and the products or packages are loaded (e.g., manually or automatically) onto the stocking device 16. After a desired quantity of products or packages are attached to stocking device 16, the combined components are removed from the packaging machine and placed in a box or container for storage or shipment. A plurality of these bag sets, each being retained by stocking device 16, may be placed into a single box. According to an alternate embodiment, stocking device 16 is held by a worker and the products or the packages are manually forced onto stocking device 16.

Figure 13:
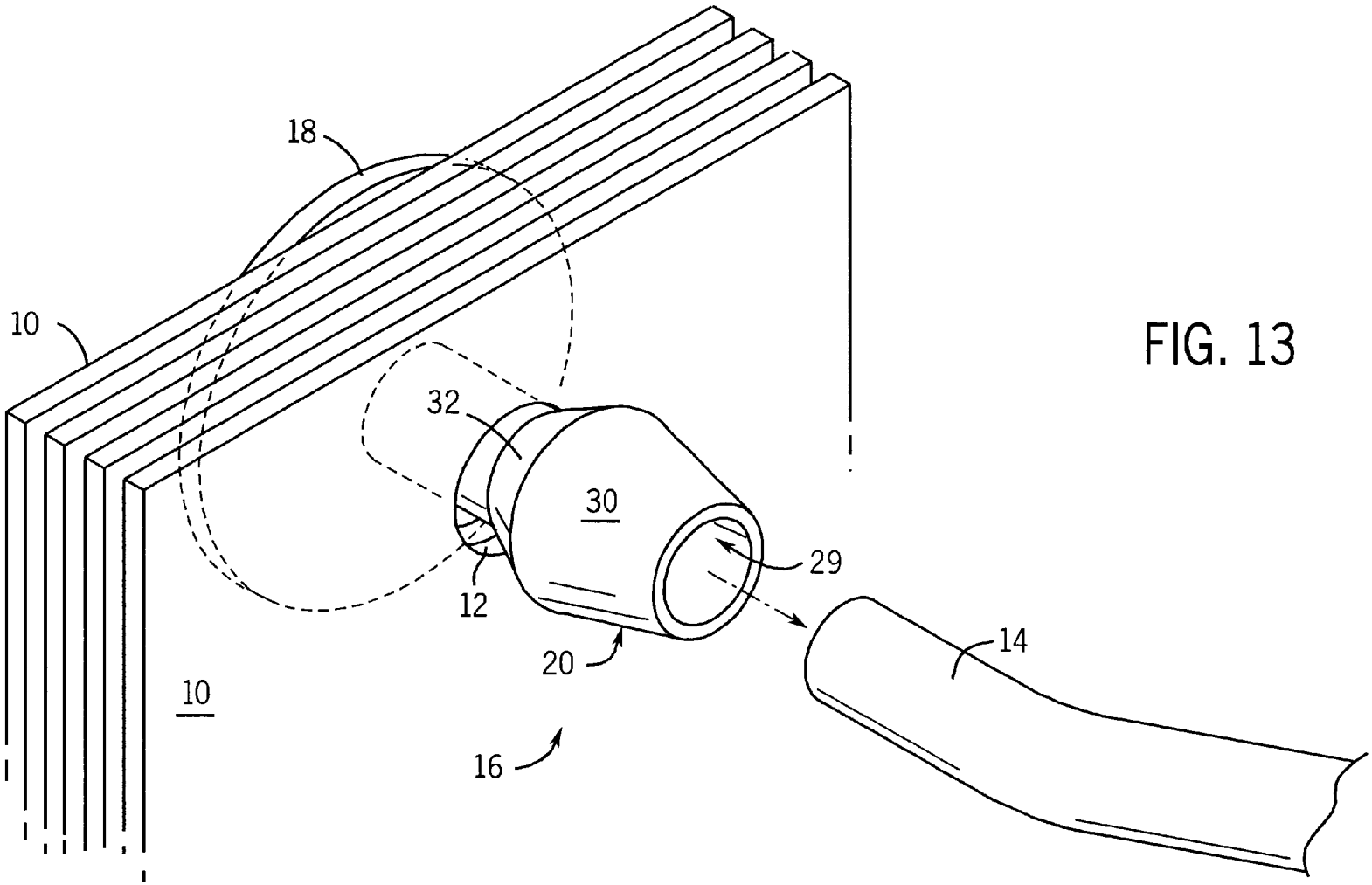
FIGS. 13 and 14 are illustrations of a plurality of bags being placed on a hanger using a stocking device.
Figure 14:
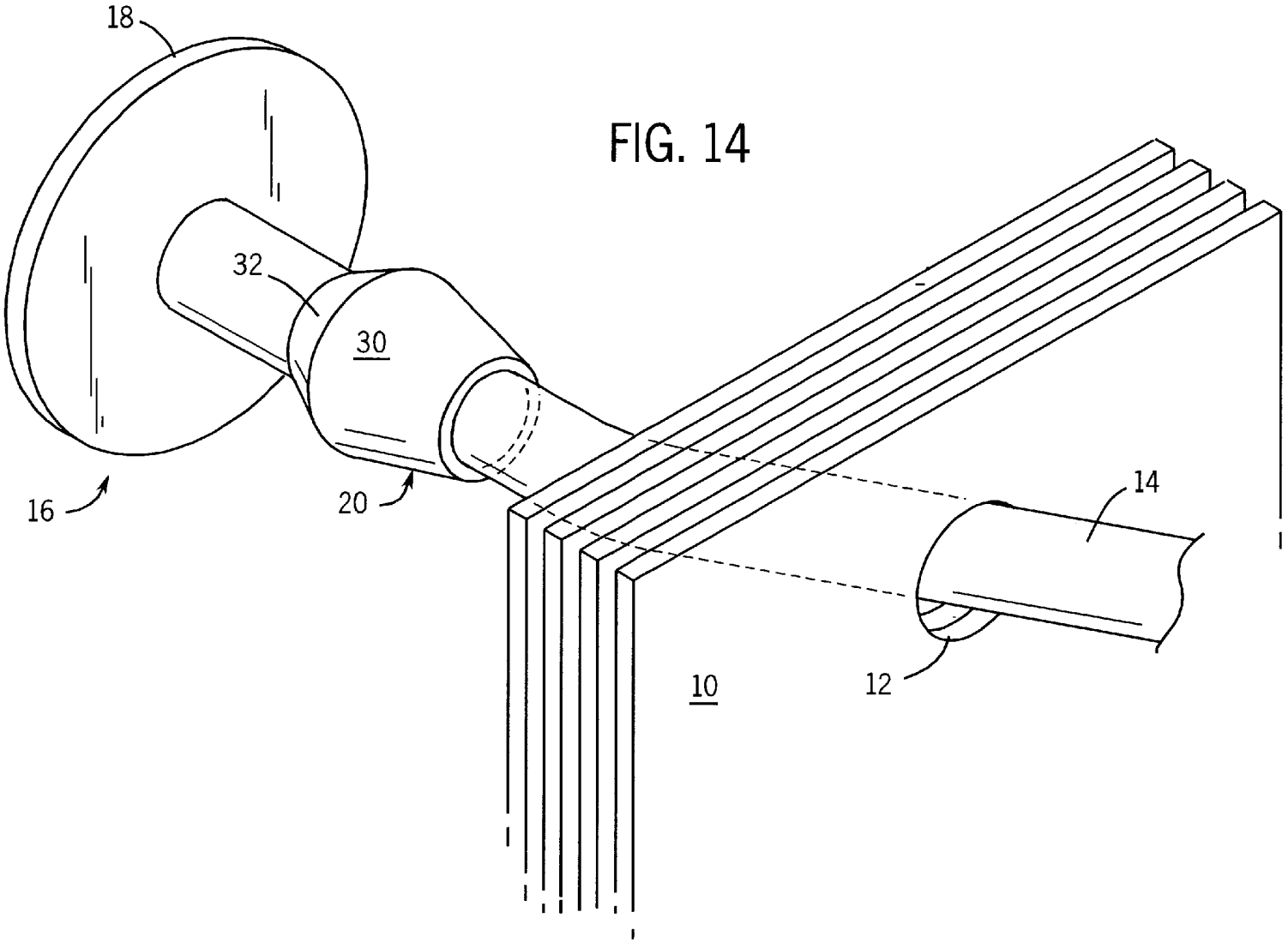
Figure 15:
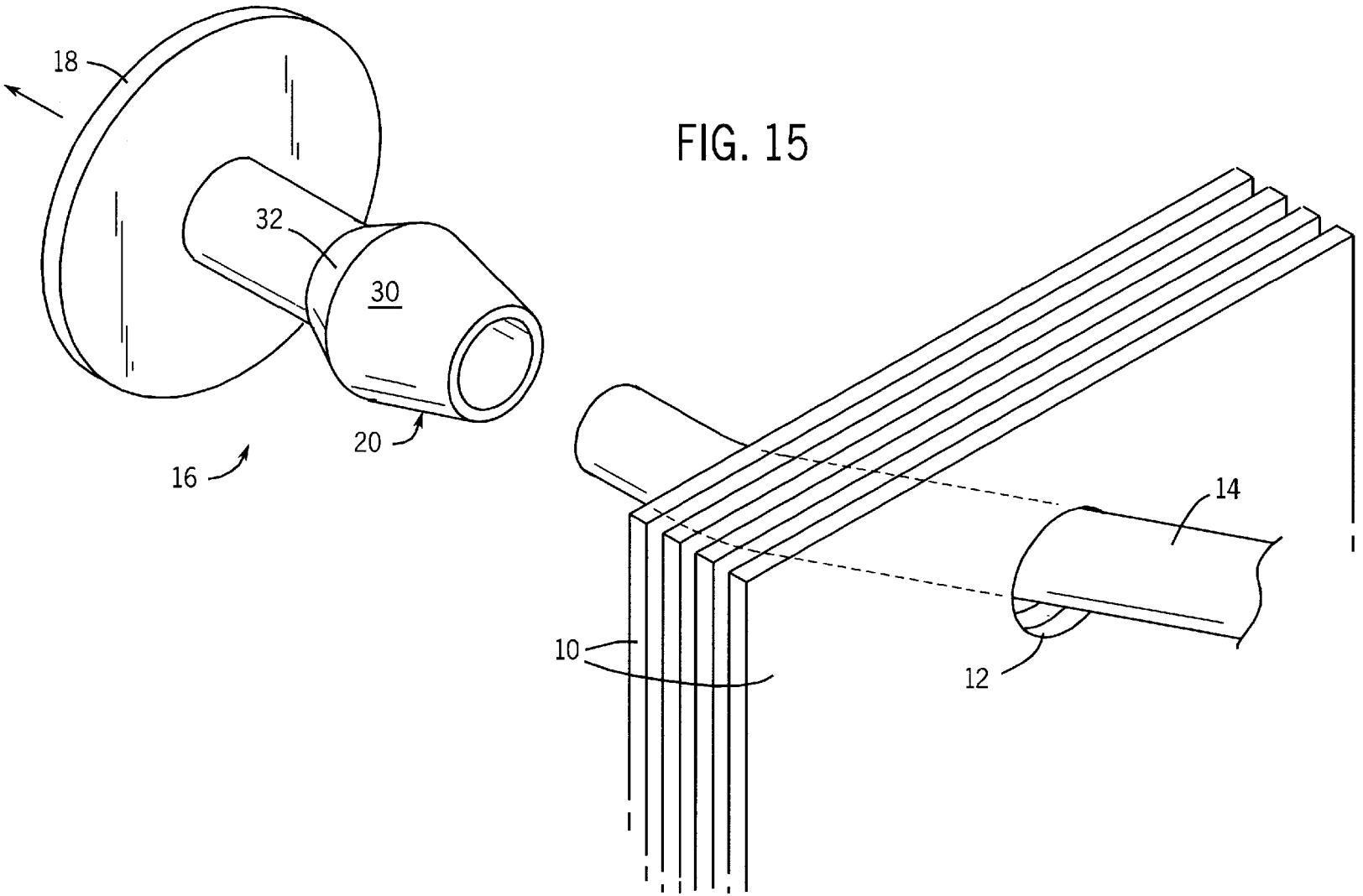
FIG. 15 is an illustration of the stocking device being removed from the hanger.

Referring to FIGS. 13–15, when a box of products is received at a store, or any other place that the products are going to be displayed, a group of bags 10 on stocking device 16 is removed from the box. Stocking device 16 is unloaded by coupling shaft 20 to the display by engaging coupling receptacle 29 and hanger 14. Because shaft 20 of stocking device 16 is inserted through apertures 12, apertures 12 (and the product packaging) are aligned substantially coaxially and may be transferred directly onto hanger 14 by pushing bags 10 from their initial position on shaft 20, over bump 26 onto hanger 14. Thus, the stocker has avoided having to individually mount each and every one of the plurality of bags 10 onto hanger 14.

Once the plurality of bag 10 has been transferred to hanger 14, stocking device 16 is removed, collected and then disposed of, reused, or recycled.

Stocking device 16 may be manufactured from a variety of materials including, but not limited to, polymeric or plastic materials (e.g., nylon, polypropylene, polyethylene, etc.), paper or paperboard, composite materials, metal (e.g., aluminum), etc.

According to a preferred embodiment, bag 10 is made from a compliant material (e.g. plastic) having a "memory" so that when bag 10 is loaded onto stocking device 16, the material around the aperture can expand or stretch and return to substantially the same shape and configuration after passing over bump 26. According to an alternate embodiment, the product packaging is made from a somewhat less flexible material (e.g. cardboard) and has an aperture shaped and sized so that the product packaging can pass over bump 26 at least two times without substantial deformation.

Figure 6:
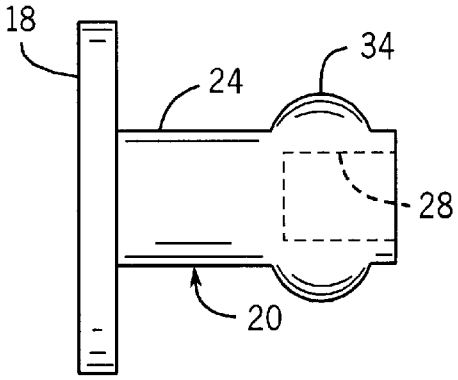
FIG. 6 is a side elevation view of the stocking device according to an alternate embodiment.
Figure 7:
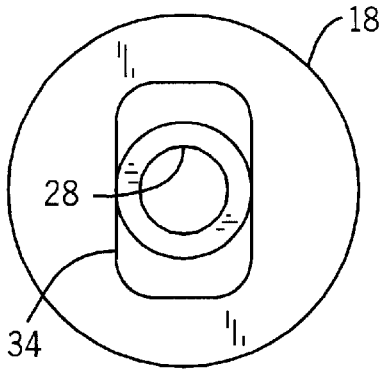
FIG. 7 is a front elevation view of the stocking device according to an alternate embodiment.

According to an alternate embodiment shown in FIGS. 6 and 7, the aperture 12 and bump 26 may be configured to retain or "capture" the product packaging by a non-interference type of engagement (e.g., non-stretching, non-flexing, or the like). The stocking device 16 includes a non-symmetrically shaped bump 34 that may be inserted into the aperture of the package substantially without resistance and then rotated to "capture" the packaging to prevent it from sliding off of the shaft until the stocking device is again rotated to allow unloading. According to an alternate embodiment, the stocking device is itself made from a compliant or flexible material and is configured to compress or flex when the packages (e.g., rigid or delicate) are being loaded or unloaded.

It will be understood that the foregoing description is of preferred exemplary embodiments of this invention, and that the invention is not limited to the specific forms shown. For example, the stocking device may have any number of a variety of designs and configurations to work with a variety of display arrangements. These and other modifications may be made in the design and arrangements of the elements without departing from the scope of the invention as expressed in the appended claims.

What is claimed is:

1. A stocking device for retaining a plurality of packages, each package having an aperture, the stocking device comprising:

a base; and a shaft extending from the base including a bump intermediate the ends of the shaft;

wherein the shaft includes one or more slots disposed along the shaft.

2. The stocking device of claim 1, wherein the shaft includes a means for cooperating with a hanger.

3. The stocking device of claim 2, wherein the cooperating means includes a coupling receptacle.

4. The stocking device of claim 1, wherein the shaft further includes a coaxial bore disposed partially along the shaft of the stocking device from the end thereof which is remote from the base.

5. The stocking device of claim 1, wherein the shaft further includes a bore disposed along the entire length of the stocking device.

6. The stocking device of claim 1, wherein the bump includes first and second ramped surfaces.

7. The stocking device of claim 6, wherein each ramped surface is conically shaped.

8. The stocking device of claim 1, wherein the shaft has a circular cross-section.

9. The stocking device of claim 1, wherein the shaft has a cross-sectional configuration adapted to be similar to the aperture.

10. The stocking device of claim 1, wherein the stocking device is made from plastic.

11. The stocking device of claim 1, wherein the stocking device is made from a flexible or compliant material.

12. The stocking device of claim 1, wherein the stocking device is configured to be mounted on a packaging machine or fixture.

13. The stocking device of claim 1, further including an area adapted to receive a label.

14. The stocking device of claim 1, wherein the one or more slots are disposed along the entire length of the shaft.

15. A method of organizing a plurality of packages, each package having an aperture, the method comprising:

providing a stocking device including a base, a shaft extending from the base, and a bump intermediate the ends of the shaft;

positioning the aperture of one or more packages near the end of the shaft remote from the base; and sliding the packages over the bump toward the base.

16. The method of claim 15, wherein the bump includes a first dimension that is greater than a second dimension of the aperture.

17. The method of claim 16, further including the step of applying sufficient force to slightly deform the packages as the aperture passes over the bump.

18. The method of claim 17, wherein the package stretches when passing over the bump.

19. The method of claim 15, further including the step of loading the stocking device onto a packaging machine or fixture.

20. The method of claim 19, further including the step of unloading the stocking device from the packaging machine or fixture.

21. The method of claim 15, further including the step of rotating the stocking device to retain the packages.

22. The method of claim 15, further including the step of labeling the stocking device.

23. The method of claim 15, further including the step of transferring the packages from the stocking device to a hanger.

24. A method of stocking a plurality of packages, each package having an aperture, the method comprising:

coupling a stocking device to a hanger, the stocking device including a base, a shaft extending from the base and having a bump intermediate the ends of the shaft, and a plurality of packages being slidably disposed on the shaft between the base and the bump; and sliding the packages over the bump and onto the hanger.

25. The method of claim 24, further including the step of removing the stocking device from the hanger.

26. The method of claim 24, further including the step of reusing the stocking device.

27. The method of claim 24, wherein the shaft includes a means for cooperating with the hanger.

28. The method of claim 27, wherein the cooperating means is a coupling receptacle and the coupling step includes placing the receptacle on the hanger.

* * * * *